US005942045A

United States Patent [19]

Raghavan et al.

[11] Patent Number: 5,942,045

[45] **Date of Patent: *Aug. 24, 1999**

[54] HARD COATING REMOVAL WITH ULTRAHIGH-PRESSURE FAN JETS

[75] Inventors: Chidambaram Raghavan, Kent; Jeffrey D. Watson, Issaquah; Steven S. Sisson, Normandy Park, all of Wash.

[73] Assignee: Flow International Corporation

[ * ] Notice: This patent issued on a continued prosecution application filed under 37 CFR 1.53(d), and is subject to the twenty year patent term provisions of 35 U.S.C. 154(a)(2).

[21] Appl. No.: 08/820,156

[22] Filed: Mar. 19, 1997

Related U.S. Application Data

[63] Continuation of application No. 08/541,326, Oct. 10, 1995, abandoned, which is a continuation of application No. 08/345,486, Nov. 28, 1994, abandoned, which is a continuation of application No. 08/172,372, Dec. 22, 1993, abandoned, which is a continuation of application No. 07/987,644, Dec. 8, 1992, abandoned.

[51] Int. Cl.[6] ..... B08B 3/02

[52] U.S. Cl. ..... 134/34; 134/38; 239/601

[58] Field of Search ..... 134/24, 32, 34, 134/38, 42; 239/601

[56] References Cited

U.S. PATENT DOCUMENTS

| | | | |
|---|---|---|---|
| 2,618,989 | 11/1952 | Cupler | 76/107 |
| 3,168,848 | 2/1965 | Bardenhagen et al. | 83/174 |
| 3,540,166 | 11/1970 | Crumley | 51/247 |
| 3,709,436 | 1/1973 | Foster | 239/287 |
| 3,726,481 | 4/1973 | Foster et al. | 239/287 |
| 3,756,106 | 9/1973 | Chadwick et al. | 83/177 |
| 3,897,002 | 7/1975 | Witty | 239/288 |
| 3,960,407 | 6/1976 | Noren | 299/17 |
| 3,987,964 | 10/1976 | Pittman et al. | 239/169 |
| 3,997,111 | 12/1976 | Thomas et al. | 239/1 |
| 4,097,000 | 6/1978 | Derr | 239/599 |
| 4,111,490 | 9/1978 | Liesveld | 299/17 |
| 4,150,794 | 4/1979 | Higgins | 239/596 |
| 4,216,906 | 8/1980 | Olsen et al. | 239/11 |
| 4,508,577 | 4/1985 | Conn et al. | 134/1 |
| 4,537,639 | 8/1985 | Shook | 134/10 |
| 4,845,903 | 7/1989 | Woodward | 51/439 |
| 5,052,624 | 10/1991 | Boers et al. | 239/525 |
| 5,078,161 | 1/1992 | Raghavan et al. | 134/16 |
| 5,116,425 | 5/1992 | Ruef | 134/17 |
| 5,167,721 | 12/1992 | McComas et al. | 134/32 |

FOREIGN PATENT DOCUMENTS

| | | | |
|---|---|---|---|
| 989083 | 9/1951 | France | 239/597 |
| 8916871 | 12/1989 | France | B08B 3/02 |

OTHER PUBLICATIONS

Applicant received promotional material regarding jet nozzles manufactured by High Energy Jets Ltd. On Feb. 27, 1986.

Prototype of Jet Nozzle sold on Oct. 1, 1991.

*Primary Examiner*—Jill Warden
*Assistant Examiner*—Saeed Chaudhry
*Attorney, Agent, or Firm*—Seed and Berry LLP

[57] ABSTRACT

A method for removing hard coatings from an underlying surface is shown and described. In a preferred embodiment, a nozzle having a particular geometry is used in a high-pressure fluid system to produce an ultrahigh-pressure fluid fan jet. The fan jet is traversed across a surface to be cleaned, thereby removing a layer of material without damaging the underlying surface. The effectiveness of the coating removal is improved by selecting an appropriate power distribution for the fan jet, a standoff distance between the fan jet and the surface to be cleaned, the speed with which the fan jet traverses the surface and the length and diameter of a settling chamber existing upstream of the nozzle.

11 Claims, 4 Drawing Sheets

HARD COATING REMOVAL WITH ULTRAHIGH-PRESSURE FAN JETS

CROSS-REFERENCE TO RELATED APPLICATION

This application is a continuation of U.S. patent application Ser. No. 08/541,326, filed Oct. 10, 1995, now abandoned, which is a continuation of U.S. patent application Ser. No. 08/345,486, filed Nov. 28, 1994, now abandoned, which is a continuation of U.S. patent application Ser. No. 08/172,372, filed Dec. 22, 1993, now abandoned, which is a continuation of U.S. patent application Ser. No. 07/987,644, filed Dec. 8, 1992, now abandoned.

TECHNICAL FIELD

This invention relates to the removal of hard coatings from a substrate, and more particularly, to a method and system for removing hard coatings from aircraft engine parts or the like using ultrahigh-pressure fluid jets.

BACKGROUND OF THE INVENTION

In various contexts it is necessary to remove coatings such as adhesives, paint and thermal spray coatings from an underlying surface, for example, jet engine components. Such coatings are difficult to remove, particularly thermal spray coatings which are exposed to high temperatures during service. Such coatings are typically used on burner cans, combustion chambers, stator and rotor blades, and other parts of a jet engine that are exposed to an extremely harsh environment.

After an engine has been in service for a given number of hours, areas of the coating will begin to weaken and deteriorate, due to being exposed to high temperatures and stresses. Because the jet engine parts are typically very costly, it is desirable to replace a weakened coating rather than replace the engine part. Given the high quality coating that needs to be achieved, it is unacceptable to simply recoat a part. It is also necessary to remove an old coating so that the substrate may be examined for wear and fatigue and repaired if necessary, after which the part may be recoated.

In the past, such hard coating removal has been accomplished by using extremely aggressive and toxic chemicals. Given environmental concerns, this method is becoming more and more unacceptable. Hard coating removal is also currently achieved by machining and grinding. However, aircraft and jet engine parts typically do not have a standard shape, given that components such as burner cans and combustion chambers are made of sheet metal and are therefore easily warped with usage. As a result, it is very difficult to set up machining for the removal of hard coating through grinding, and such a process is virtually impossible to automate. Although parts may be ground by hand, such a process is time consuming and slow, and is believed to potentially expose an operator to toxic dust.

A need therefore exists for an improved method of removing hard coatings from underlying surfaces.

SUMMARY OF THE INVENTION

It is therefore an object of this invention to provide an improved method of cleaning surfaces.

It is another object of this invention to provide a method for uniformly removing a layer of matter from an underlying surface without damaging the underlying surface.

It is another object of this invention to provide a method for removing hard coatings from a substrate that will produce consistent results.

These and other objects of the invention, as will be apparent as preferred embodiments are described more fully herein, are accomplished by providing a method and system using an ultrahigh=pressure fan jet nozzle that produces an ultrahigh-pressure fluid fan jet. In a preferred embodiment, pressurized fluid, typically water, is generated by high-pressure, positive displacement pumps or other suitable means. Such pumps pressurize a fluid by having a reciprocating plunger that draws the fluid from an inlet area into a pressurization chamber during an intake stroke, and acts against the fluid during a pumping stroke, thereby forcing pressurized fluid to pass from the pressurization chamber into an outlet chamber, from which it is collected into a manifold. The pressurized fluid is then directed through the nozzle of a tool thereby creating an ultrahigh-pressure jet that may be used to perform a particular task, for example cleaning a surface, such as on aircraft parts. Such jets may reach pressures up to and beyond 55,000 psi.

In a preferred embodiment, the nozzle has an inner surface defined by a conical bore that extends from a first end of the nozzle to a second end of the nozzle. As a result, the first end is provided with an entrance orifice through which a volume of pressurized fluid may enter the nozzle and the second end is provided with an exit orifice through which the pressurized fluid may exit after passing through the body of the nozzle. The second end of the nozzle is further provided with a wedge-shaped notch that extends from its widest point at the second end in towards the first end of the nozzle, intersecting the exit orifice. As a result, the shape of the exit orifice is defined by the intersection of the conical bore and the wedge-shaped notch. The shape of the exit orifice causes the pressurized fluid leaving the nozzle to do so as a fan jet, having a substantially linear footprint, the width of which varies with changes in the geometry of the nozzle. For purposes of discussion, the footprint may be viewed as a thin rectangle, or as an oval having a very high aspect ratio, such as 100 to 1, having a major axis and a minor axis.

This fan jet may be swept across a surface to be cleaned in the direction of the minor axis of the footprint to selectively remove a layer of material. In a preferred embodiment, the standoff, which may be defined as the distance between the exit orifice and the surface to be cleaned, is between 0.5 and 1 inch, and optimum results are believed to be achieved when the standoff is 0.75 inch. When the standoff is greater than 1 inch, for example, 1.25 inches, the fluid fan jet widens and becomes ineffective in removing a hard coating. The effectiveness of the fan jet is also affected by the speed with which the jet is traversed across the surface to be cleaned. In a preferred embodiment, the traverse speed ranges between 400 and 1,600 inches per minute, with slightly optimal results occurring at 1,200 inches per minute. If the traverse speed is slow, for example, less than 200 inches per minute, unacceptable striations are created on the part being cleaned. The effectiveness of the cleaning process is also affected by the quality of the fan jet, which is affected by the length and diameter of a settling chamber upstream of the nozzle. The settling chamber length may be defined as the distance from the last point where a flow disturbance occurs and the entrance orifice. Such flow disturbance points may occur, for example, at a connection point with an ultrahigh-pressure source of fluid, or any sharp bend or change of diameter that changes the flow path of the fluid from that of a plain, smooth bore. In a preferred embodiment, a settling chamber length is 4 to 6 inches, although it is believed that acceptable results are achieved if this length is at least 0.75 inch. It is further believed that acceptable results are achieved if the diameter of the settling chamber is between ⅛ and ⅜ inch.

The power distribution of the fan jet may be controlled by changing an internal angle of the conical bore and an angle of the wedge-shaped notch. This is beneficial because different power distributions may be more appropriate than others for a particular task. For example, in the context of cleaning as discussed above, it is believed to be desirable to have a fan jet with a uniform power distribution, which may be accomplished by correctly adjusting the geometry of the nozzle.

In a preferred embodiment, an outer surface of the nozzle is also conical such that the second end has a substantially circular, planar surface. In addition, the wedge-shaped notch is aligned with a diameter of the circular planar surface such that the resulting fan jet will be vertically aligned with a longitudinal axis of the nozzle. In an alternative embodiment, the wedge-shaped notch may be offset such that it is not aligned with a diameter of the surface of the second end, thereby producing a "side-firing" fan jet that exits the nozzle at an angle relative to the longitudinal axis of the nozzle. Such a side-firing jet may also be produced by grinding the wedge-shaped notch at an angle relative to the longitudinal axis of the nozzle, such that the axis of the nozzle is not in the plane of the notch.

In a yet another alternative embodiment, the wedge-shaped notch may be at an angle relative to the longitudinal axis of the nozzle such that the axis of the nozzle is in the plane of the notch. This produces an "angled" fan jet.

In a preferred embodiment illustrated herein, the nozzle is mounted in a receiving cone such that when a volume of pressurized fluid passes through the nozzle, the receiving cone acts against the nozzle causing the inner walls of the nozzle near and at the exit orifice to be in a compressive state of stress. This condition increases the nozzle's resistance to fatigue and wear.

In a preferred embodiment, the nozzle is manufactured by machining out a conical bore from a blank of annealed stainless steel. The internal surface of the nozzle is finished by pressing a cone-shaped die into the conical bore, thereby eliminating machining marks and improving the inner surface quality. The part is then heat treated, before or after which the outer surface of the nozzle may be finished. Once the part is heat treated, a wedge-shaped notch is machined out of the second end of the nozzle to a sufficient depth such that a shape of the exit orifice is defined by the intersection of the conical bore and the wedge-shaped notch.

DETAILED DESCRIPTION OF THE INVENTION

It is often desirable and necessary to remove a hard coating such as an adhesive, paint or thermal spray coating, from an underlying surface, such as jet engine components. When cleaning such a surface, it is desirable to have a 100% clean surface and to remove a layer of coating without damaging the underlying surface. This is accomplished in an embodiment of the current invention using a method and system employing ultrahigh-pressure fluid fan jets.

Ultrahigh-pressure fluid jets in general may be generated by high-pressure, positive displacement pumps (not shown) and may reach pressures up to and beyond 55,000 psi. The pressurized fluid generated by the pump is typically collected in a manifold from which the fluid is directed through the nozzle of a tool (not shown), thereby creating an ultra-high pressure jet that may be used to perform a particular task.

In the current state of the art, hard coating removal is achieved by applying chemicals or by machining and grinding the surface. These methods have limitations, however, given environmental concerns and difficulties involved in attempting to automate or set up machinery for grinding a coating off of a surface having a nonstandard shape, for example, a burner can or a combustion chamber that may be warped due to use.

Figure 1:
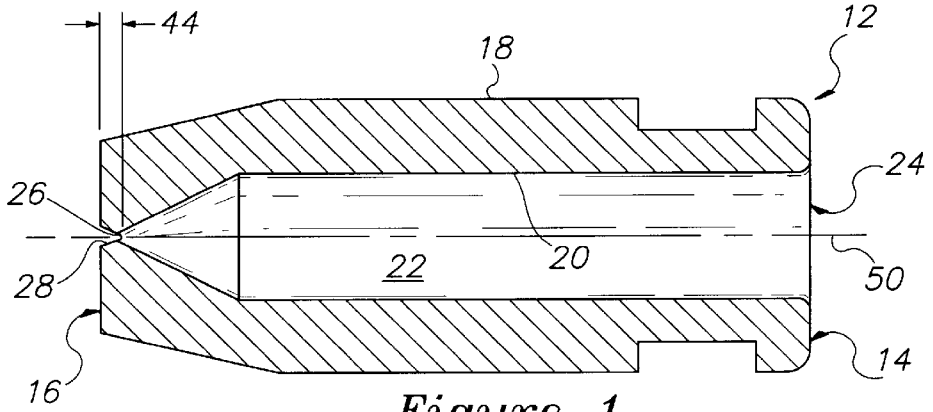
FIG. 1 is a cross-sectional view of a nozzle illustrating an element of a preferred embodiment of the present invention.
Figure 2:
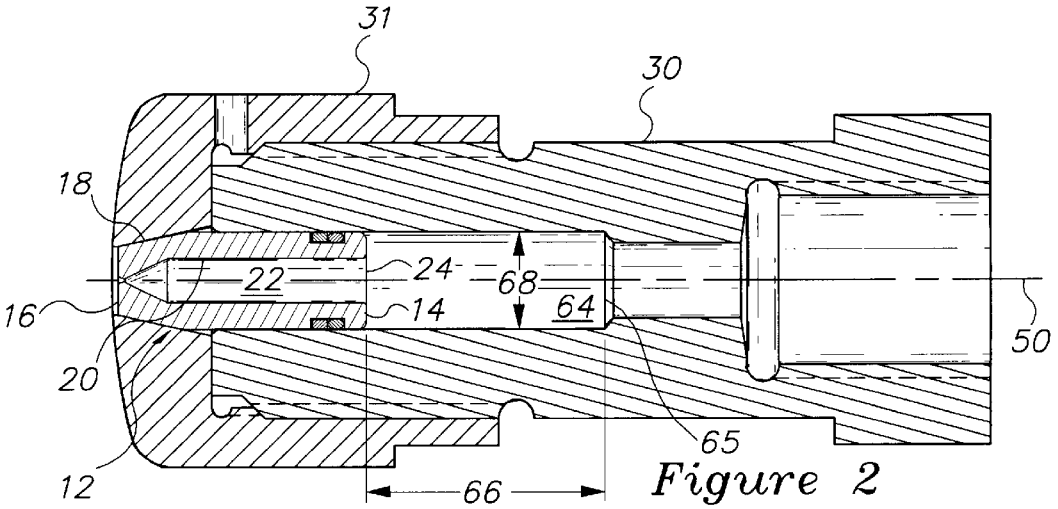
FIG. 2 is a cross-sectional view of the nozzle of FIG. 1 mounted in a receiving cone.

FIGS. 1 and 2 illustrate a preferred embodiment of a nozzle used in preferred embodiments of the present invention. A nozzle 12 has a first end 14, a second end 16, an outer surface 18 and an inner surface 20. The inner surface 20 is defined by a conical bore 22 that extends from the first end 14 to the second end 16, thereby creating an entrance orifice 24 and an exit orifice 26 in the first end 14 and second end 16, respectively. A wedge-shaped notch 28 extends from the second end 16 in towards the first end 14 to a depth 44 such that the notch 28 and conical bore 22 intersect. The shape of the exit orifice 26 is therefore defined by this intersection of the conical bore 22 and the wedge-shaped notch 28. As a volume of pressurized fluid passes through the nozzle 12 and out the exit orifice 26, the shape of the exit orifice 26 causes the pressurized fluid to exit the nozzle as a fan jet, having a substantially linear footprint.

As illustrated in FIG. 2, the nozzle 12 in a preferred embodiment is mounted within a receiving cone 30, including a nozzle nut 31. As pressurized fluid passes through the receiving cone 30 and the nozzle 12, the receiving cone 30 acts against the nozzle 12, thereby placing the inner surface 20 of the nozzle 12 near and at the exit orifice 26 in a compressive state of stress. By being in compression rather than tension, the nozzle 12 is more resistant to fatigue and wear.

Figure 6A:
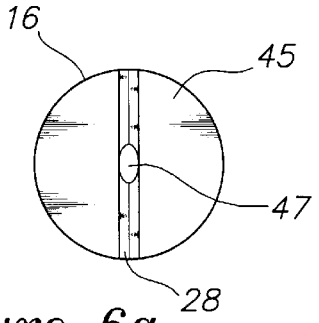
FIGS. 6*a–b* are bottom plan view illustrating alternative embodiments of the nozzle of FIG. 1.
Figure 7A:
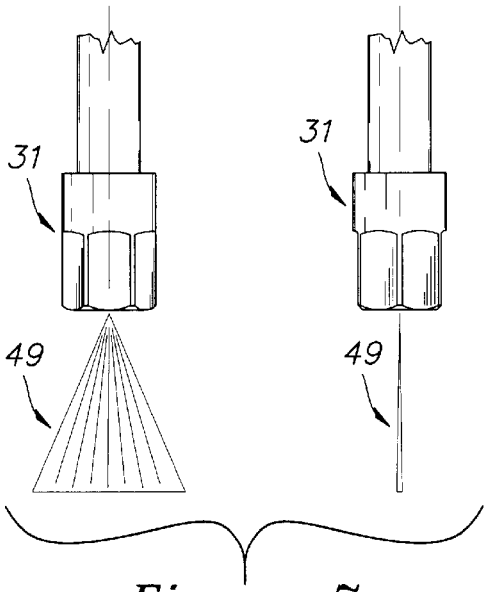
FIGS. 7*a–c* are diagrams illustrating front and side views of three alternative embodiments of the nozzle of FIG. 1 and resulting fan jets.

In preferred embodiment, the outer surface 18 of the nozzle 12 is conical such that the second end 16 has a substantially circular, planar surface 45, as illustrated in FIG. 6*a*. The wedge-shaped notch 28 is aligned along a diameter of the circular surface 45, such that it passes through a center 47 of the second end 16. As a result, the fan jet of pressurized fluid will exit the nozzle 12 in a direction substantially aligned with a longitudinal axis 50 of the nozzle 12. This fan jet may be referred to as a "straight" fan 49, as illustrated in FIG. 7*a*. A straight fan 49 may be useful in various contexts, for example, in cleaning or coating removal, as will be discussed in greater detail below.

Figure 6B:
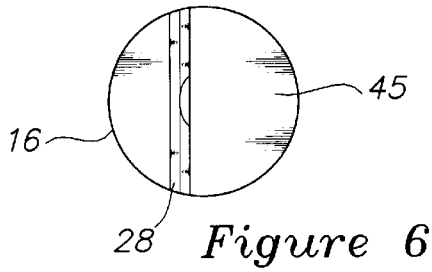
Figure 7B:
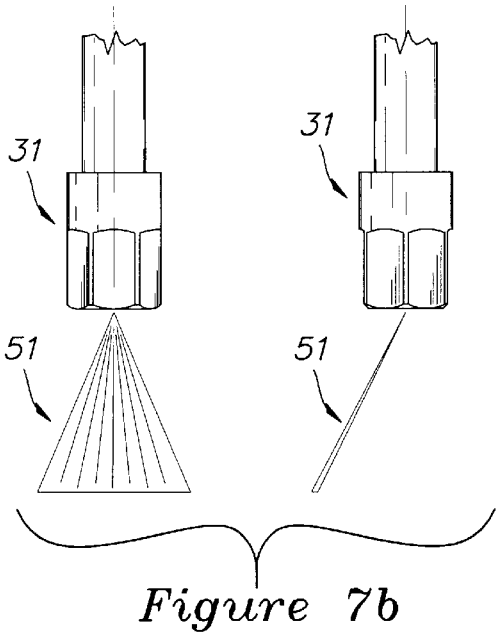

In an alternative embodiment, as illustrated in FIG. 6*b*, the wedge-shaped notch 28 is offset such that is it not aligned along a diameter of the circular surface 45 of the second end 16. As a result, the fan jet will exit the nozzle 12 at an angle relative to the longitudinal axis 50 of the nozzle 12. Such a fan jet may be referred to as a "side-firing" fan 51, as illustrated in FIG. 7*b*. A side-firing fan jet 51 may also be produced by grinding the wedge-shaped notch 28 at an angle relative to the longitudinal axis 50 of nozzle 12, such that the axis 50 of nozzle 12 is not in the plane of the notch 28. Side-firing fan jets 51 may be useful in various contexts, for example, when it is necessary to clean or remove grout from sides of a narrow, deep area, such as a gap between two concrete blocks.

Figure 7C:
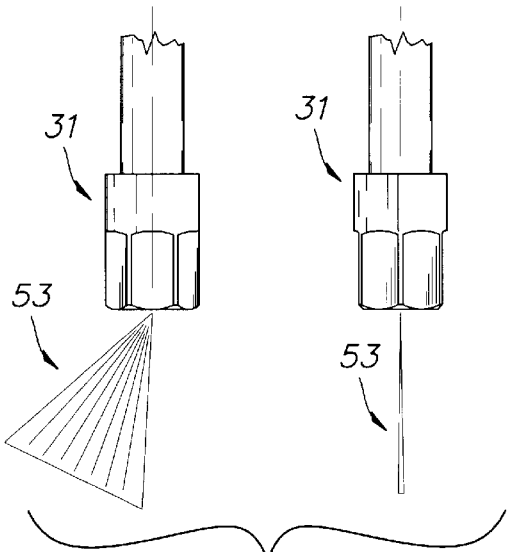

In yet another alternative embodiment, as illustrated in FIG. 7*c*, the wedge-shaped notch 28 may be at an angle relative to the longitudinal axis 50 of the nozzle 12 such that the axis 50 of the nozzle 12 is in the plane of the notch 28. This produces an "angled" fan jet 53, which is believed to be useful in various contexts.

Figure 3:
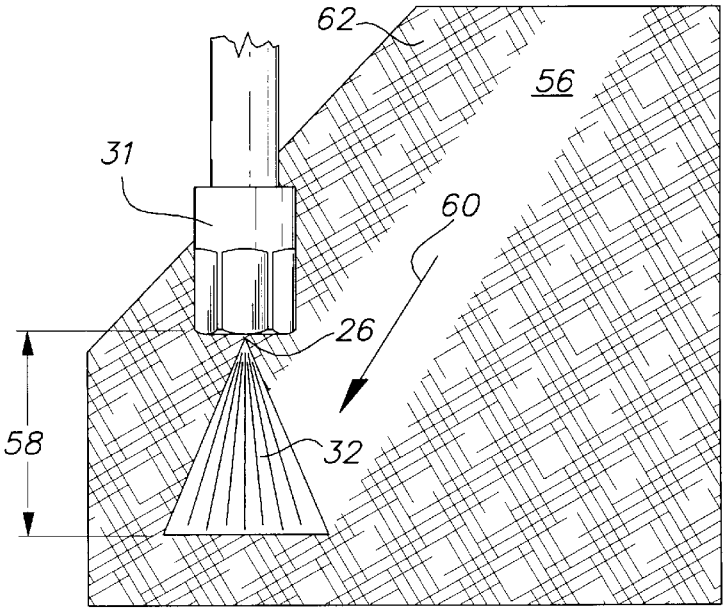
FIG. 3 is an illustration of a surface being cleaned in accordance with the present invention, utilizing the nozzle of FIG. 1.

As discussed above, the pressurized fluid exiting the nozzle 12 is in the form of a fan jet having a substantially linear footprint, the width of which varies with changes in the geometry of the nozzle. For purposes of discussion, the footprint may be viewed as a thin rectangle, or as an oval having a very high aspect ratio, such as 100 to 1, having a major axis and a minor axis. The geometry of the fan jet may be controlled by adjusting the geometry of the nozzle, different geometries being more desirable depending on the task at hand. For example, in cleaning or hard coating removal it is often desirable to selectively remove a layer of matter from an underlying surface, without damaging the underlying surface. It is also desirable and often necessary to have a 100% clean surface. As illustrated in FIG. 3, by sweeping the fan jet 32 produced by the preferred embodiment of the nozzle 12 illustrated herein across a surface 56 to be cleaned in the direction 60 of the minor axis of the fan jet's footprint, it is possible to remove a layer of material 62 evenly and completely, thereby avoiding the problems associated with the use of chemicals or grinding.

It is believed that the effectiveness of the removal of a hard coating 62 in accordance with the present invention is affected by the standoff 58 or distance between the exit orifice 26 and the surface being cleaned 56, the speed with which the fan jet is traversed across the surface to be cleaned 56, the length 66 and diameter 68 of the settling chamber 64 or area between the last occurring flow disturbance and the entrance orifice 24, and the power distribution of the fan jet. Addressing each of these points in turn, in a preferred embodiment, the standoff 58, as illustrated in FIG. 3, is between 0.5 and 1 inch, with optimum results believed to be achieved when this distance is 0.75 inch. When a fan jet 32 first emerges from the nozzle 12, it appears glassy. As the standoff 58 is increased, the fan jet 32 entrains air, causing the high-pressure fluid to break into droplets. It is believed that in the preferred range for the standoff 58 of 0.5 to 1 inch, the fluid fan jet 32 is made up of high-speed droplets which result in the propagation of high-frequency elastic waves which cause the coating to degrade. As the standoff 58 is further increased, it is believed that the droplets slow down, thereby decreasing the effectiveness of the fan jet in removing a hard coating 62 in accordance with the present invention. It is therefore believed to be desirable to have sufficient standoff 58 so that a droplet formation is created, yet a small enough standoff 58 so that the droplets are still moving at a high velocity.

As mentioned above, the effectiveness of the fan jet is affected by the speed with which the fan jet 32 traverses the surface 56 to be cleaned, as illustrated in FIG. 3. In a preferred embodiment, the traverse speed is between 400 and 1,600 inches per minute, with slightly optimum results occurring at 1,200 inches per minute. As slow traverse rates, for example less than 200 inches per minute, unacceptable striations are created on the substrate or surface being cleaned 56. This problem is avoided by using the traverse speeds noted above and causing the fan jet to make multiple passes over the surface 56. For example, if the given task was to remove a layer of hard coating 62 from a cylindrical combustion chamber having its longitudinal axis in a vertical direction, a fan jet may traverse the inner surface of the combustion chamber in a vertical direction while the chamber is rotated about its axis, the jet being indexed by a small distance, for example, 0.05 to 0.5 inch, at a selected rate. This pattern would be followed for one complete cycle, a cycle being defined as moving from one end of the combustion chamber to the other and back to the first end. Such a cycle would then be repeated until the combustion chamber is cleaned to the level required.

The length 66 and diameter 68 of the settling chamber 64 upstream of the nozzle 12 will also affect the quality of the fan jet 32 and the effectiveness of the coating removal. A length 66 of the settling chamber 64, as illustrated in FIG. 2, may be defined as the distance between the point 65 along the flow path corresponding to the last flow disturbance before the fluid enters the nozzle and the entrance orifice 24. The final flow disturbance point 65 will typically be a connection with an ultrahigh-pressure fluid source, or it may be any sharp bend or change in diameter 68 of the flow path that is different from a straight, smooth bore. It will be appreciated by one of ordinary skill in the art that diverging areas of the flow path cause adverse pressure gradients resulting in separation and turbulent flow which can cause deterioration in the quality of the fan and impair its performance. The length 66 and diameter 68 of the settling chamber 64 is therefore believed to be significant in the performance of the fan jet in removing coatings. In a preferred embodiment, the length 66 of the settling chamber 64 is between 4 and 6 inches, although it is believed that acceptable results are achieved when this length 66 is at least 0.75 inch. It is further believed that acceptable results are achieved when the diameter 68 of the settling chamber 64 is between ⅛ and ⅜ inch. It will appreciated by one of ordinary skill in the art, that a number of nozzles 12 may be aligned and translated across a surface in unison to clean a larger area more quickly and efficiently.

Figure 4A:
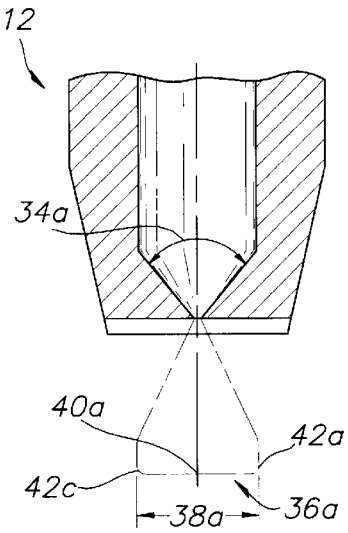
FIGS. 4*a–c* are diagrams illustrating the effect of changing an internal cone angle of the nozzle of FIG. 1 on the power distribution of a resulting fan jet.
Figure 4B:
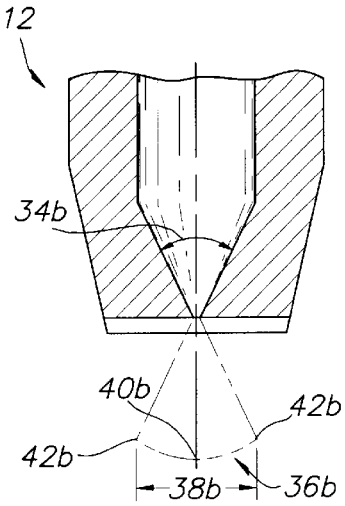
Figure 4C:
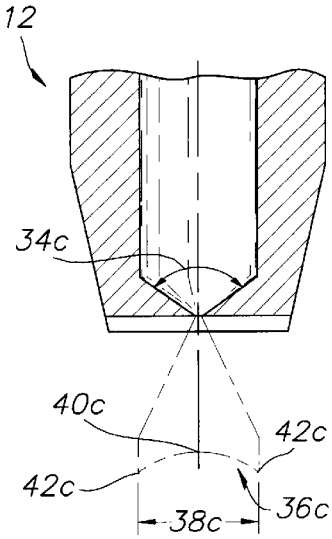

As illustrated in FIGS. 4*a–c*, the geometry of the nozzle 12 may be altered to control the resulting geometry and power distribution of the fan jet. For example, as discussed in the cleaning illustration above, it is desirable to have a uniform power distribution along a width of the fan jet thereby resulting in an even distribution of power across the surface being cleaned 56. In a preferred embodiment, as illustrated in FIG. 4*a*, an internal angle 34*a* of the conical bore 22 is 90° to achieve a uniform power distribution 36*a* of the fan jet, such that the power at the center 40*a* at the ends 42*a* of the fan jet is the same. In an alternative embodiment, as illustrated in FIG. 4*b*, the internal angle 34*b* of the conical bore 22 is less than 90°, for example, 60°, thereby resulting in a power distribution 36*b* that is concentrated at a center 40*b* of the fan jet and tapers at the ends 42*b* of the fan jet. In another alternative embodiment, as illustrated in FIG. 4*c*, an internal angle 34*c* of the conical bore 22 is greater than 90°, for example, 105°, resulting in a power distribution 36*c* that is concentrated on the ends 42*c* of the fan jet and minimal at the center 40*c* of the fan jet.

Each of these configurations has its own uses. For example, the even power distribution illustrated in FIG. 4*a* is preferred for many cleaning tasks because it acts uniformly along its width against the surface to be cleaned 56.

Figure 5A:
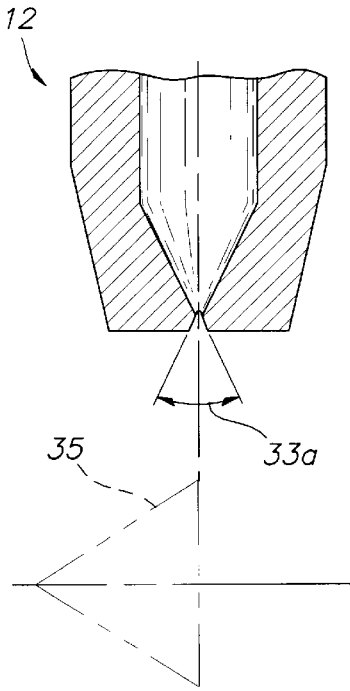
FIGS. 5*a–c* are diagrams illustrating the effect of changing an external wedge angle of the nozzle of FIG. 1 on the shape of the resulting fan jet.
Figure 5B:
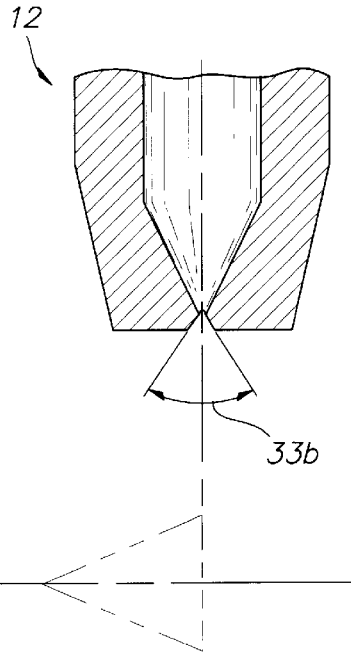
Figure 5C:
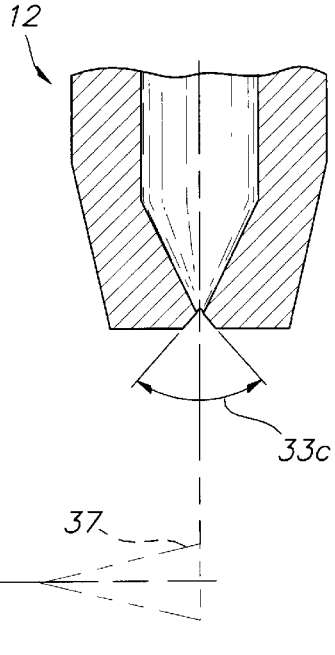

As illustrated in FIGS. 5*a–c,* changes to an external angle 33 of the wedge-shaped notch 28 may be made to control the shape and thickness of the fan jet. As illustrated in FIG. 5*a,* a small wedge angle 33*a* produces a wide-angled fan 35, while a large wedge angle 33*c,* as shown in FIG. 5*c,* produces a narrow-angled fan 37. Although not shown, the thickness of the fan jet also increases with an increase in the wedge angle. Again, different configurations have different applications, for example, a narrow-angled fan such as that produced by the wide-angled wedge angle in FIG. 5*c* will be more focused in delivering power to a target, which may be necessary if the distance between the nozzle 12 and the surface being cleaned 56 is relatively large.

The nozzle 12 is manufactured by machining a blank 64 from any high-strength, metallic alloy, for example, annealed steel. In a preferred embodiment, the nozzle 12 is made from Carpenter Custom 455 stainless steel. The conical bore 22 is machined out of the blank, after which the inner surface 20 is finished by pressing a cone-shaped die (not shown) into the conical bore 22, thereby eliminating machining marks and improving the quality of the inner surface 20. The nozzle 12 is then heat treated at a given temperature for a given amount of time, to increase the strength of the material. The correct temperature and time are dependent on the material used, and will be known by one of ordinary skill in the art. For example, in a preferred embodiment, where the nozzle is made from Carpenter Custom 455, the nozzle is treated at 900° F. for four hours, and then air cooled. The outer surface 18 of the nozzle 12 may be finished before or after the nozzle is heat treated. In a preferred embodiment, the outer surface 18 is conical, such that the second end 16 has a substantially circular planar surface 45.

Figure 8:
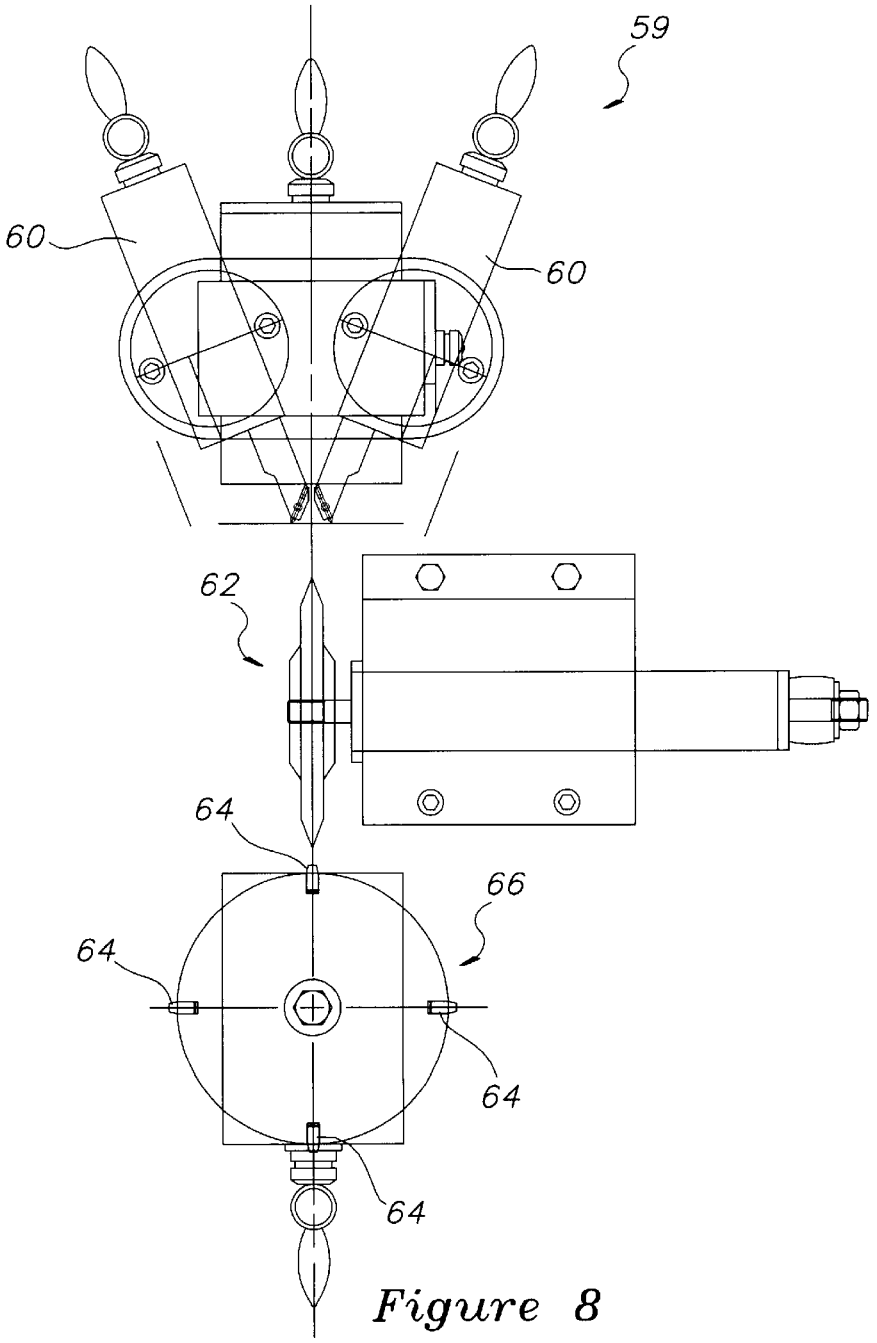
FIG. 8 is a top plan view of a grinding fixture used to manufacture the nozzle of FIG. 1.

The wedge-shaped notch 28 is then machined into the second end 16 of the blank 64, or nozzle 12, to a sufficient depth such that the notch 28 intersects the exit orifice 26 created by the conical bore 22. As illustrated in FIG. 8, the grinding fixture 59 includes two diamond dressers 60 which may be positioned to create a desired angle such that when the dressers 60 act against a grinding wheel 62, they will produce the same angle on the edge of the grinding wheel 62. Several of the blanks 64 are mounted on a turret 66, which may move both laterally and longitudinally to align the blank 64 with the grinding wheel 62. As the grinding wheel 62 acts against the blank 64 to create the wedge-shaped notch 28, the angle of which corresponds to the desired angle of the dressers and grinding wheel, lubricants are used to cool the machinery and prevent damage, the method and necessity of which will be understood by one of ordinary skill in the art.

A first blank 64 is used to calibrate the system. An operator of the grinding fixture 59 grinds a wedge-shaped notch 28 into the blank 64, and then rotates the turret 66 90° to inspect the alignment of the wedge-shaped notch 28 with the conical bore 22. This inspection is done through a microscope (not shown). If the wedge-shaped notch 28 is not properly aligned, adjustments are made by moving the turret 66. Once the desired alignment is achieved, multiple nozzles 12 may then be completed very quickly by mounting multiple blanks 64 on the turret 66 and grinding the wedge-shaped notch 28 via the grinding wheel 62. In addition, different depths of the wedge-shaped notch 28 will be desired, depending on the intended task and the size of the nozzle, as measured by a diameter 68 of the nozzle 12. The desired depth is calibrated and checked by measuring the length 66 of a minor axis of the exit orifice 26 which will have an oval shape due to the intersection of the wedge-shaped notch 28 and the conical bore 22.

A method for removing a layer of material from an underlying surface has been shown and described. From the foregoing, it will be appreciated that, although embodiments of the invention have been described herein for purposes of illustration, various modifications may be made without deviating from the spirit and scope of the invention. For example, although the invention was described in the context of removing hard coatings from aircraft components, it will be understood that other surfaces could be cleaned and other materials removed in accordance with the present invention. Thus, the present invention is not limited to the embodiments described herein, but rather is defined by the claims which follow.

We claim:

1. A method for removing a layer of matter from an underlying surface comprising:

positioning a nozzle having a first end provided with an entrance orifice and a second end provided with an exit orifice such that a distance between the exit orifice and the surface is between 0.5 and 1 inch;

forcing a volume of pressurized fluid through the nozzle such that the fluid exits the nozzle through the exit orifice as a high-pressure fluid fan jet; and traversing the fan jet across the surface at a rate of between 400 and 1,600 inches per minute.

2. The method according to claim 1 wherein the nozzle further comprises:

an outer surface and an inner surface, the inner surface being defined by a conical bore extending through the nozzle from the first end to the second end such that the first end is provided with the entrance orifice and the second end is provided with the exit orifice and the pressurized fluid may pass through the entrance orifice, through the nozzle and out the exit orifice to perform a task, wherein a wedge-shaped notch extends from the second end in towards the first end such that a shape of the exit orifice is defined by the intersection of the conical bore and the wedge-shaped notch and wherein the exit orifice causes the pressurized fluid to exit the nozzle as a fan jet having a substantially linear footprint.

3. The method according to claim 2 wherein an internal angle of the conical bore near the exit orifice is 90° such that a power distribution of the fan jet is uniform along a width of the fan jet.

4. The method according to claim 2, further comprising:

passing the fluid jet over the surface multiple times until the surface is cleaned to a desired level.

5. The method according to claim 1 wherein a settling chamber is provided upstream of the nozzle having a length of at least 0.75 inch and a diameter of between ⅛ and ⅜ inch, thereby improving the quality of the fan jet.

6. A method for removing a layer of matter from an underlying surface with minimal damage to the underlying surface comprising:

forcing a volume of pressurized fluid through a nozzle having a first end, a second end, an outer surface and an inner surface, the inner surface being defined by a conical bore extending through the nozzle from the first end to the second end such that the first end is provided with the entrance orifice and the second end is provided with the exit orifice and the pressurized fluid may pass through the entrance orifice, through the nozzle and out the exit orifice to perform a task, wherein a wedge-shaped notch extends from the second end in towards the first end such that a shape of the exit orifice is defined by the intersection of the conical bore and the wedge-shaped notch and wherein the exit orifice causes the pressurized fluid to exit the nozzle as a fan jet having a substantially linear footprint; and sweeping the fan jet across a surface to be cleaned in a direction of a minor axis of the footprint.

7. The method according to claim 6 wherein an internal angle of the conical bore near the exit orifice is 90° such that a power distribution of the fan jet is uniform along a width of the fan jet.

8. The method according to claim 6, further comprising:

positioning the nozzle relative to the surface such that a distance between the exit orifice and the surface is between 0.5 and 1 inch.

9. The method according to claim 6 wherein the fan jet is swept across the surface at a rate of between 400 and 1,600 inches per minute.

10. The method according to claim 6 wherein a settling chamber is provided upstream of the nozzle having a length of at least 0.75 inch and a diameter of between ⅛ and ⅜ inch, thereby improving the quality of the fan jet.

11. A method for removing hard coatings from jet engine parts comprising:

positioning a nozzle having a first end, a second end, an outer surface and an inner surface, the inner surface being defined by a conical bore extending through the nozzle from the first end to the second end such that the first end is provided with an entrance orifice and the second end is provided with an exit orifice and a volume of pressurized fluid may pass through the entrance orifice, through the nozzle and out the exit orifice to perform a task, wherein a wedge-shaped notch extends from the second end in towards the first end such that a shape of the exit orifice is defined by the intersection of the conical bore and the wedge-shaped notch and wherein the exit orifice causes the pressurized fluid to exit the nozzle as a fan jet having a substantially linear footprint, relative to a surface to be cleaned such that a distance between the exit orifice and the surface is between 0.5 and 1 inch;

positioning the nozzle relative to a source of the high-pressure fluid such that a settling chamber is provided upstream of the nozzle having a length of at least 0.75 inch and a diameter of ⅛ to ⅜ inch;

forcing a volume of pressurized fluid through the nozzle such that the fluid exits the nozzle as a high-pressure fluid fan jet;

traversing the fluid jet across the surface at a rate of between 400 and 1,600 inches per minute; and passing the fan jet over the surface multiple times until the surface is cleaned to a desired degree.

* * * * *